United States Patent [19]

Shinagawa et al.

[11] 4,264,356

[45] Apr. 28, 1981

[54] FERRITIC PRECIPITATION-HARDENED SOFT MAGNETIC STAINLESS STEEL

[75] Inventors: Susumu Shinagawa; Taizo Suzuki, both of Sendai; Tuyoshi Otomo, Shiogama, all of Japan

[73] Assignee: Tohoku Special Steel Works Limited, Sendai, Japan

[21] Appl. No.: 23,311

[22] Filed: Mar. 23, 1979

[30] Foreign Application Priority Data

Mar. 23, 1978 [JP] Japan ..... 53/32407

[51] Int. Cl.[3] ..... C22C 38/06

[52] U.S. Cl. ..... 75/124; 75/128 T; 148/37

[58] Field of Search ..... 75/124, 128 T; 148/37

[56] References Cited

U.S. PATENT DOCUMENTS

| | | | |
|---|---|---|---|
| 2,614,921 | 10/1952 | Tanczyn | 75/124 |
| 2,624,668 | 1/1953 | Binder | 148/37 |
| 2,694,626 | 11/1954 | Tanczyn | 75/124 |
| 3,337,331 | 8/1967 | Ljungberg | 148/37 |
| 3,499,802 | 3/1970 | Lagneborg | 75/128 T |
| 3,658,514 | 4/1972 | Lula et al. | 75/128 T |
| 3,837,847 | 9/1974 | Bieber | 75/128 T |
| 3,865,644 | 2/1975 | Hellner et al. | 75/124 |

FOREIGN PATENT DOCUMENTS

| | | | |
|---|---|---|---|
| 46-934 | 1/1971 | Japan | 75/124 |
| 248237 | 12/1969 | U.S.S.R. | 75/124 |

OTHER PUBLICATIONS

Metals Handbook, vol. 1, 8th ed. 1961, p. 409.

The Making, Shaping and Treating of Steel, United States Steel, 8th ed., pp. 1112–1117.

*Primary Examiner*—L. Dewayne Rutledge

*Assistant Examiner*—John P. Sheehan

*Attorney, Agent, or Firm*—Young & Thompson

[57] ABSTRACT

A ferritic precipitation-hardened soft magnetic stainless steel is disclosed. This steel consists by weight percentage of not more than 0.1% of C, 12.0–22.0% of Cr, 1.5–6.0% of Nb, at least one of Al and Ti, provided that an amount of Al used alone is 0.5–4.0%, an amount of Ti used alone is 0.5–3.0% and an amount of Al and Ti used together is 0.5–4.0% (in the latter case, the amount of Ti does not exceed 3.0%), the remainder being Fe and incidental impurities. The steel exhibits substantially 100% ferrite phase after solution heat- and aging-treatments and has improved magnetic properties, corrosion resistance and hardness.

4 Claims, 3 Drawing Figures

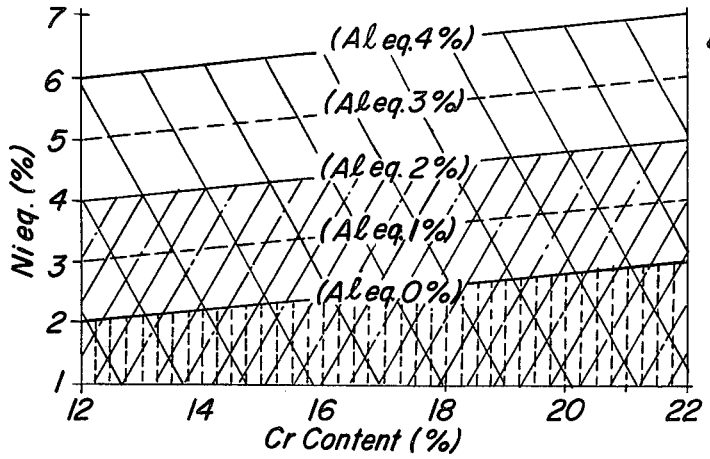
FIG.1
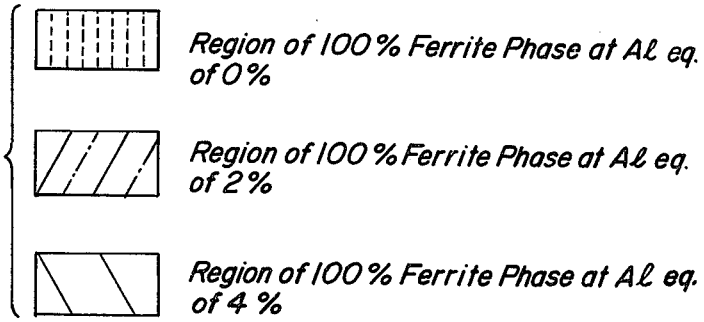
FIG.3
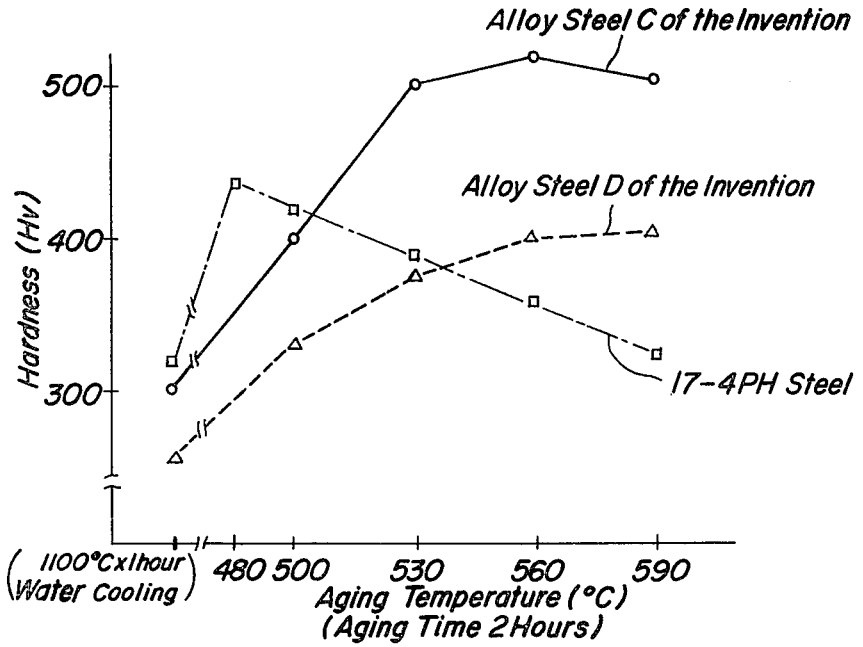

FERRITIC PRECIPITATION-HARDENED SOFT MAGNETIC STAINLESS STEEL

This invention relates to ferritic precipitation-hardened soft magnetic stainless steels and is provides soft magnetic stainless steels having excellent magnetic properties and corrosion resistance and high hardness.

Generally, ordinary stainless steels include soft magnetic stainless steels such as 18Cr-steel, precipitation hardening stainless steels such as 17-4PH steel, non-magnetic and corrosion resistant stainless steels such as 18Cr-8Ni steel, and the like. In these stainless steels, however, the corrosion resistance and hardness are not combined with the magnetic properties concurrently.

It is a matter of course that the soft magnetic stainless steel has excellent magnetic properties. Now, if the corrosion resistance and hardness are improved without losing the magnetic properties, the soft magnetic stainless steel becomes very advantageous in view of its applications. Therefore, many attempts have been made to develop alloy steels having improved corrosion resistance and hardness. For instance, there are proposed stainless steels having improved corrosion resistance and strength by addition of Mo, Nb, Ti, Ni, Co or the like to ferritic stainless steel such as 18Cr steel, but they are still insufficient in the improvement of the properties. Furthermore, they are produced by annealing as a final step, but are not of the precipitation hardening type. Besides, there have been proposed a process for imrpoving magnetic properties and corrosion resistance by adding Si, Ti or the like to low nickel stainless steels, and a process for improving magnetic properties by adding Ti to high chromium ferritic stainless steels, and the like. In these processes, the resulting steels belong to the work hardening and annealing types but do not belong to the precipitation hardening type, so that the hardness is not satisfactory. Moreover, 17-4PH steel is a typical example of the precipitation hardened stainless steels, but has such a the drawback that the corrosion resistance after the precipitation hardening is poor.

The invention eliminates the above mentioned drawbacks of the soft magnetic stainless steels in the prior art and provides ferritic precipitation-hardened soft magnetic stainless steels having improved magnetic properties, corrosion resistance and hardness concurrently.

The alloy steel according to the invention is a ferritic precipitation-hardened soft magnetic stainless steel consisting by weight percentage of not more than 0.1% of carbon, 12.0–22.0% of chromium, 1.5–6 0% of nickel, at least one of aluminum and titanium, provided that an amount of aluminum used alone is 0.5–4.0%, an amount of titanium used alone is 0.5–3.0% and an amount of aluminum and titanium used together is 0.5–4.0% (in the latter case, the amount of titanium does not exceed 3.0%), the remainder being iron and incidental impurities and exhibiting substantially 100% ferrite phase after a solution heat treatment, whose hardness is considerably increased by an aging treatment without deteriorating magnetic properties and corrosion resistance. In a preferred embodiment of the invention, at least one of not more than 6.0% of molybdenum, not more than 3.0% of silicon, not more than 2.0% of copper and not more than 1.0% of niobium may be further added in order to surely retain the properties of the alloy steel according to the invention as mentioned above or to positively improve the properties thereof. Moreover, the alloy steel according to the invention is subjected to a common solution heat treatment before shaping.

The invention will now be described in greater detail with reference to the accompanying drawings, wherein:

FIG. 1 is a graph showing the relation between the chromium content, aluminum equivalent and nickel equivalent for the formation of the region of 100% ferrite phase;

FIG. 3 is a graph showing the relation between the aging temperature and the hardness.

Figure 2:
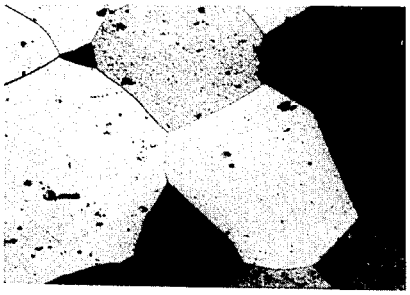
FIG. 2 is a photomicrograph showing a typical ferrite phase of the alloy steel according to the invention.

The alloy steel according to the invention has the chemical composition as defined above. Now, the inventors have found out that it is necessary to adjust a balance of ingredients within a range of the above chemical composition in order to render the structure of the alloy steel substantially 100% ferrite phase and elucidated from many experiments that there is a relationship of chromium content, aluminum equivalent and nickel equivalent as shown in FIG. 1. This fact will be explained in detail below with reference to FIG. 1.

The contents of Ni, C and Cu, each being referred to as an austenite stabilizing element, are expressed by the following equation (1) as a nickel equivalent:

$$\text{Ni eq.} = \text{Ni}(\%) + 13 \times \text{C}(\%) + 0.3 \times \text{Cu}(\%) \quad (1)$$

The contents of Cr, Al, Ti, Mo, Si and Nb, each being referred to as a ferrite stabilizing element, are expressed by the following equation (2) as an aluminum equivalent except for chromium:

$$\text{Al eq.} = \text{Al}(\%) + 0.6 \times \text{Ti}(\%) + 0.3 \times \text{Mo}(\%) + 0.4 \times \text{Si}(\%) + 0.3 \times \text{Nb}(\%) \quad (2)$$

When the chromiun content (%) and the nickel- and aluminum equivalents (%) in the equations (1) and (2) are set to given values, a relation between the values and a region of 100% ferrite phase is shown in FIG. 1. The term "100% ferrite phase" used herein means the formation of 100% ferrite phase over a temperature range of a practical solution heat treatment (900°–1,200° C.).

From the data of FIG. 1, the following equation (3) is derived:

$$F = \text{Al equivalent} + 1/10(\text{Cr}\%-12) - (\text{Ni equivalent}-2) \quad (3)$$

In the equation (3), the value of F has a permissible error of about ±0.2.

From equation (3), the following three facts appear:

(a) When the Cr content, Al equivalent and Ni equivalent are such that $F>0$, the alloy steel exhibits 100% ferrite phase over the temperature range of practical solution heat treatment (900°–1,200° C.);

(b) When the balance is $-0.5 \leqq F \leqq 0$, ferrite and austenite phases are formed at a certain temperature zone in the above temperature range (900°–1,200° C.), while 100% ferrite phase is formed at a temperature zone other than the above zone; and (c) When the balance is $F \leqq -0.5$, it is very difficult to form 100% ferrite phase over the practical temperature range of 900°–1,200° C.

In FIG. 2 is shown 100% ferrite phase of a typical alloy steel according to the invention as a photomicrograph (magnification, ×100) using a marble etching solution (hydrochloric acid 50 cc, saturated solution of copper sulfate 50 cc).

That is, when the content of each of Cr, Ni, Al and Ti, which are basic ingredients in the alloy steel according to the invention, is within the above defined range and satisfies $F>0$, the alloy exhibits substantially 100% ferrite phase. If it is difficult to adjust the balance of the basic ingredients only by the addition of Al and Ti, proper amounts of Mo, Si, Cu, Nb and the like may be added in accordance with the intended use of the alloy steel so as to form 100% ferrite phase. In the case of $-0.5 \leqq F \leqq 0$, soltuion heat treatment should be avoided at a temperature causing the formation of both ferrite and austenite phases.

The relation shown in FIG. 1 is established from many experiments, so that if the value of F is permitted to have an error of about $\pm 0.2$, the experimental results of the alloy steels having the chemical composition as defined above are confirmed to be coincident with the results by microscopic test.

According to the invention, the reason for limiting the chemical composition of the alloy steel to the ranges as mentioned above is as follows:

(1) Chromium is an element indispensable to improve the corrosion resistance, to stabilize the formation of 100% ferrite phase and to decrease the coercive force in the formation of ferrite soft magnetic stainless steel. For this purpose, chromium must be added in an amount of not less than 12.0%. However, when the amount of Cr exceeds 22.0%, cold workability deteriorates suddenly.

(2) Nickel is an element indispensable to effect precipitation hardening of the alloy steel according to the invention together with aluminum and titanium and is effective for the improvement of corrosion resistance. When the amount of Ni is less than 1.5%, the addition effect is small, while when the amount exceeds 6.0%, the formation of 100% ferrite phase is not stabilized and the magnetic properties deteriorate.

(3) Aluminum and titanium are elements indispensable to precipitation hardening together with nickel. Al and Ti may be added alone, but the addition of both Al and Ti is most effective. When the amount of Al alone is less than 0.5%, the addition effect is small, while when the amount exceeds 4.0%, the workability deteriorates. When the amount of Ti alone is less than 0.5%, the addition effect is small, while when the amount exceeds 3.0%, the workability deteriorates. Furthermore, when the total amount of Al and Ti is less than 0.5%, the addition effect is small, while when the total amount exceeds 4.0%, the workability deteriorates. Particularly, when Al and Ti are added together, if the amount of Ti exceeds 3.0%, the workability deteriorates.

Moreover, Ti forms a carbide to fix carbon and is effective for the improvement of corrosion resistance and magnetic properties.

(4) Molybdenum is added for improving the corrosion resistance and is effective for stabilizing the ferrite phase. When the amount of Mo exceeds 6.0%, however, the magnetic properties deteriorate.

(5) Silicon is added for improving the magnetic properties and is effective for stabilizing the ferrite phase. When the amount of Si exceeds 3.0%, however, the workability deteriorates suddenly.

(6) Copper is added for improving the corrosion resistance against sea water or the like. When the amount of Cu exceeds 2.0%, however, the magnetic properties deteriorate.

(7) Niobium is effective for fixing carbon and improving the corrosion resistance and magnetic properties. When the amount of Nb exceeds 1.0%, however, brittleness is caused.

(8) Carbon is apt to degrade the corrosion resistance and magnetic properties by the formation of a carbide with Cr or the like even when being fixed with Nb and Ti, so that it is desirable to avoid the addition of carbon as far as possible. However, the upper limit of carbon added to not more than 0.1%, taking into account the unavoidable amount in the production of the alloy steel.

The invention will be described in greater detail with reference to the following example.

The magnetic properties, hardness and corrosion resistance of the alloy steel according to the invention were compared with those of typical steels of the prior art. That is, 18Cr ferritic steel was used as a comparative steel for magnetic properties, 18Cr-8Ni austenitic stainless steel was used as a comparative steel for corrosion resistance, and 17-4PH precipitation hardening stainless steel was used as a comparative steel for hardness.

The chemical compositions of the alloy steels according to the invention and the comparative steels are shown in the following Table 1.

TABLE 1

| | | C | Cr | Ni | Al | Ti | (weight %) Others |
|---|---|---|---|---|---|---|---|
| Comparative steels | 18Cr | 0.09 | 18.1 | — | — | — | Si:0.65 |
| | 18Cr-8Ni | 0.05 | 18.3 | 8.2 | — | — | Si:0.52 |
| | 17-4PH | 0.05 | 17.0 | 3.8 | — | — | Cu:4.2 Si:0.41 Nb:0.36 |
| Alloy steels according to the invention | A | 0.03 | 15.2 | 4.0 | 3.1 | — | Mo:2.0 Nb:0.5 |
| | B | 0.06 | 17.0 | 3.9 | 2.2 | — | Mo:3.1 Nb:0.6 |
| | C | 0.05 | 17.1 | 4.0 | 2.0 | — | Mo:4.0 Si:1.0 Cu:1.2 Nb:0.5 |
| | D | 0.06 | 20.0 | 2.3 | 2.0 | 0.2 | — |
| | E | 0.02 | 15 | 5.0 | 1.0 | 1.2 | Mo:3.0 Si:0.5 Nb:0.2 |
| | F | 0.03 | 15 | 4.5 | — | 2.0 | Mo:5.0 |

The alloy steels A, B, C, D, E and F according to the invention were confirmed to be within a range of chemical composition as defined above and to exhibit 100% ferrite phase after the solution heat treatment.

The magnetic properties of each steel after the solution heat treatment and subsequent aging treatment are shown in the following Table 2. Moreover, the conditions of each treatment are as follows:

18Cr steel: A-treatment 900° C.×1 hour, air cooling

18Cr-8Ni steel: A-treatment 1,100° C.×1 hour, water cooling 17-4PH steel: A-treatment 1,050° C.×1 hour, air cooling; H-treatment 480° C.×2 hours, air cooling Alloy steels A, B, C, D, E and F according to the invention: A-treatment 1,100° C.×1 hour, water cooling; H-treatment 540°-600° C.×2 hours, air cooling Note:

(1) A-treatment means a solution heat treatment and H-treatment means an aging treatment.

(2) The treatments in the following Tables 3 and 4 are the same as described above.

TABLE 2

| | | After A-treatment | | | | After A- and H-treatments | | | |
|---|---|---|---|---|---|---|---|---|---|
| | | Magnetic flux density (KG) | | | Coercive force | Magnetic flux density (KG) | | | Coercive force |
| | | $B_1$ | $B_5$ | $B_{20}$ | (Oe) | $B_1$ | $B_5$ | $B_{20}$ | (Oe) |
| Comparative steels | 18Cr | 1.3 | 8.4 | 11.8 | 1.4 | | | | |
| | 18Cr-8Ni | | | | | | | | |
| | 17-4PH | | | | | | | | |
| Alloy steels according to the invention | A | 0.6 | 3.7 | 7.2 | 1.6 | 0.5 | 3.6 | 7.0 | 1.6 |
| | B | 0.8 | 5.6 | 9.0 | 1.6 | 0.8 | 5.4 | 9.1 | 1.4 |
| | C | 0.6 | 4.9 | 8.4 | 1.8 | 0.6 | 5.2 | 8.4 | 1.6 |
| | D | 0.7 | 6.0 | 9.4 | 1.6 | 0.7 | 7.0 | 9.5 | 1.6 |
| | E | 1.1 | 7.8 | 10.0 | 1.4 | 1.2 | 8.0 | 10.5 | 1.4 |
| | F | 0.5 | 2.8 | 5.7 | 1.9 | 0.3 | 3.2 | 5.7 | 2.2 |

As seen from the data of Table 2, the magnetic properties of the alloy steel according to the invention hardly change between the solution heat treatment and the aging treatment and are slightly less than or equal to those of the conventional 18Cr steel.

In the following Table 3 is shown the hardness of the steels as a Vickers hardness under a load of 500 g. Furthermore, the relation between the hardness and the aging temperature is shown in FIG. 3 with respect to typical examples of the steels as mentioned above.

TABLE 3

| | | After A-treatment | | After A- and H-treatments | |
|---|---|---|---|---|---|
| Comparative steels | 18Cr | 180 | Hv | — | Hv |
| | 18Cr-8Ni | 176 | | — | |
| | 17-4PH | 320 | | 440 | |
| Alloy steels according to the invention | A | 230 | | 450 | |
| | B | 280 | | 510 | |
| | C | 290 | | 520 | |
| | D | 240 | | 400 | |
| | E | 280 | | 500 | |
| | F | 250 | | 440 | |

As seen from the data of Table 3, the hardness of the alloy steel according to the invention after the aging treatment is equal to or higher than that of the conventional 17-4PH steel.

The result of corrosion testing is shown in the following Table 4. The corrosion test was preformed by immersing a sample in a solution of 1N-NaCl at room temperature for 30 days. The corrosion resistance was evaluated by the degree of color change on the surface of the sample after removal from the solution.

TABLE 4

| | | After A-treatment | After A- and H-treatments |
|---|---|---|---|
| Comparative steels | 18Cr | x | |
| | 18Cr-8Ni | ◎ | |
| | 17-4PH | Δ | x |
| Alloy steels according to the invention | A | ◎ | ◎ |
| | B | ◎ | ◎ |
| | C | ◎ | ◎ |
| | D | Δ | Δ |
| | E | ◎ | ◎ |
| | F | ◎ | ◎ |

Note:
◎ no color change
Δ slight color change
x complete color change

As is apparent from the data of Table 4, the corrosion resistance of the alloy steel D according to the invention containing no molybdenum is slightly inferior to that of the conventional 18Cr-8Ni steel, but is superior to those of the conventional 18Cr steel and 17-4PH steel. Particularly, the corrosion resistance of the alloy steels A, B, C, E and F according to the invention, each containing molybdenum, is equal or slightly superior to that of the conventional 18Cr-8Ni steel.

From the data of Tables 2, 3, and 4, it can be seen that even if the alloy steel according to the invention is considerably subjected to precipitation hardening by aging after the solution heat treatment, the magnetic properties and corrosion resistance are not degraded at all. That is, the alloy steels according to the invention concurrently provide magnetic properties substantially equal to those of the conventional ferritic 18Cr steel, the hardness equal to or higher than that of the conventional precipitation-hardened 17-4PH steel, and the corrosion resistance equal to that of the conventional corrosion-resistant 18Cr-8Ni austenitic stainless steel as a soft magnetic material. In the conventional stainless steels, it has been proved from the above data that the steel having excellent magnetic properties is poor in the hardness and corrosion resistance, the precipitation-hardened steel having a high hardness is poor in the magnetic properties and corrosion resistance, and the steel having an excellent corrosion resistance is low in hardness. In other words, alloy steels concurrently satisfying a hardness of more than 400 Hv, magnetic properties required for soft magnetic material and a good corrosion resistance are for the first time provided by the invention.

The alloy steels according to the invention are most suitable for use as plungers of electromagnetic valves, and casings for watches and the like owing to the excellent properties mentioned above. When the alloy steel according to the invention is used in an electromagnetic valve, wear resistance, service life and reliability are considerably improved as compared with the conventional valves because the alloy steel has excellent corrosion resistance and hardness. Furthermore, when the alloy steel according to the invention is used in watches, dents and scratches are resisted and the magnetic shielding effect against external magnetic fields in excellent because the alloy steel has a corrosion resistance equal to that of the conventional 18Cr-8Ni stainless steels, high hardness and excellent magnetic properties required for soft magnetic material. Of course, the alloy steels according to the invention are widely and industrially used as soft magnetic materials for various applications.

What is claimed is:

1. A ferritic precipitation-hardened soft magnetic stainless steel which has been subjected to solution heat treatment and aging, consisting essentially by weight percentage of not more than 0.1% of carbon, 12.0–22.0% of chromium, 1.5–6.0% of nickel, at least one of aluminum and titanium, provided that an amount of aluminum used alone is 0.5–4.0%, an amount of titanium used alone is 0.5–3.0% and an amount of aluminum and titanium used together is 0.5–4.0% (in the latter case, the amount of titanium does not exceed 3.0%), in which the value F=Al equivalent +1/10 (Cr%-12)−(Ni equivalent-2)≧−0.5 in the solid solution state, balance essentially iron, and exhibiting substantially 100% ferrite phase and having improved magnetic properties, corrosion resistance and hardness.

2. A ferritic precipitation-hardened soft magnetic stainless steel which has been subject to solution heat treatment and aging, consisting essentially by weight percentage of not more than 0.1% of carbon, 12.0–22.0% of chromium, 1.5–6.0% of nickel, at least one of aluminum and titanium, provided that an amount of aluminum used alone is 0.5–4.0%, an amount of titanium used alone is 0.5–3.0%, an amount of aluminum and titanium used together is 0.5–4.0% (in the latter case, the amount of titanium does not exceed 3.0%), at least one of not more than 6.0% of molybdenum, not more than 3.0% of silicon, not more than 2.0% of copper and not more than 1.0% of niobium, in which the value F=Al equivalent+1/10 (Cr%-12)−(Ni equivalent-2)±−0.5 in the solid solution state, balance essentially iron, and exhibiting substantially 100% ferrite phase and having improved magnetic properties, corrosion resistance and hardness.

3. A steel as claimed in claim 1, containing an effective amount up to 2.0% of copper, said amount being effective to improve the corrosion resistance against sea water.

4. A steel as claimed in claim 2, containing an effective amount up to 2.0% of copper, said amount being effective to improve the corrosion resistance against sea water.

* * * * *